US011599055B2

(12) United States Patent
Hamada

(10) Patent No.: US 11,599,055 B2
(45) Date of Patent: Mar. 7, 2023

(54) IMAGE FORMING APPARATUS THAT IDENTIFIES SHEET THICKNESS

(71) Applicant: KYOCERA Document Solutions Inc., Osaka (JP)

(72) Inventor: Takuya Hamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/461,717

(22) Filed: Aug. 30, 2021

(65) Prior Publication Data

US 2022/0066378 A1 Mar. 3, 2022

(30) Foreign Application Priority Data

Aug. 31, 2020 (JP) ..... JP2020-145647

(51) Int. Cl.
*B65H 7/12* (2006.01)
*G03G 15/00* (2006.01)

(52) U.S. Cl.
CPC ..... *G03G 15/703* (2013.01); *B65H 7/125* (2013.01); *B65H 2511/13* (2013.01); *B65H 2511/524* (2013.01); *B65H 2553/30* (2013.01)

(58) Field of Classification Search
CPC ..... B65H 7/12; B65H 7/125; B65H 2511/13; B65H 2511/524; B65H 2553/30; G03G 15/703
See application file for complete search history.

(56) References Cited

U.S. PATENT DOCUMENTS 5,565,627 A * 10/1996 Dorr ..... G01N 29/221 73/159
6,913,259 B2 * 7/2005 Phinney ..... G01N 29/223 271/262
2008/0203654 A1 * 8/2008 Chujo ..... B65H 7/12 271/262
2009/0166961 A1 7/2009 Namikawa
2014/0079460 A1 * 3/2014 Kanaya ..... B65H 3/0653 400/583
2014/0091516 A1 * 4/2014 Okitsu ..... B65H 7/125 271/262
2014/0311236 A1 * 10/2014 Schulz ..... G01B 21/08 73/159
2016/0060056 A1 * 3/2016 Yoshimura ..... B65H 7/06 271/265.04

FOREIGN PATENT DOCUMENTS

JP 2009-161292 A 7/2009

* cited by examiner

*Primary Examiner* — Thomas A Morrison
(74) *Attorney, Agent, or Firm* — IP Business Solutions, LLC

(57) ABSTRACT

A transmitter transmits ultrasonic wave of a predetermined volume. A reflected ultrasonic wave receiver receives reflected ultrasonic wave, transmitted from the transmitter and reflected by a sheet. A permeated ultrasonic wave receiver receives permeated ultrasonic wave, transmitted by the transmitter and permeated through the sheet. A volume detector detects reflected volume of the reflected ultrasonic wave, and permeated volume of the permeated ultrasonic wave. The decider identifies a thickness of the sheet being transported by a transport device, and decides whether multifeed of the sheets is occurring, on a basis of a comparison result between the detected reflected volume and a reference reflected volume, and a comparison result between the detected permeated volume and a reference permeated volume.

8 Claims, 7 Drawing Sheets

Fig.5

| | PLAIN PAPER | THICK PAPER | THIN PAPER | MULTIFEED |
|---|---|---|---|---|
| REFLECTED VOLUME P | P2(REFERENCE) | P1(LARGE) | P3(SMALL) | P3(SMALL) |
| PERMEATED VOLUME Q | Q2(REFERENCE) | Q3(SMALL) | Q1(LARGE) | Q3(SMALL) |

IMAGE FORMING APPARATUS THAT IDENTIFIES SHEET THICKNESS

INCORPORATION BY REFERENCE

This application claims priority to Japanese Patent Application No. 2020-145647 filed on Aug. 31, 2020, the entire contents of which are incorporated by reference herein.

BACKGROUND

The present disclosure relates to an image forming apparatus.

Some of existing image reading apparatuses include a sensor for detecting a thick paper, and a sensor for detecting multifeed, provided independently from each other, to prevent occurrence of paper jam on the transport route.

SUMMARY

The disclosure proposes further improvement of the foregoing techniques.

In an aspect, the disclosure provides an image forming apparatus including a paper feeding section, a transport device, a transmitter, a reflected ultrasonic wave receiver, a permeated ultrasonic wave receiver, a volume detector, and a decider. The paper feeding section feeds a sheet. The transport device transports the sheet. The transmitter transmits ultrasonic wave of a predetermined volume. The reflected ultrasonic wave receiver receives reflected ultrasonic wave, transmitted from the transmitter and reflected by the sheet. The permeated ultrasonic wave receiver receives permeated ultrasonic wave, transmitted by the transmitter and permeated through the sheet. The volume detector detects reflected volume of the reflected ultrasonic wave and outputs reflected volume information, and also detects permeated volume of the permeated ultrasonic wave and outputs permeated volume information. The decider identifies a thickness of the sheet being transported by the transport device, and decides whether multifeed of the sheets is occurring, on a basis of a comparison result between the reflected volume indicated by the reflected volume information and a reference reflected volume, and a comparison result between the permeated volume indicated by the permeated volume information and a reference permeated volume.

BRIEF DESCRIPTION OF THE DRAWINGS

FIG. 5 is a table showing data stored in a storage device;

DETAILED DESCRIPTION

Figure 1:
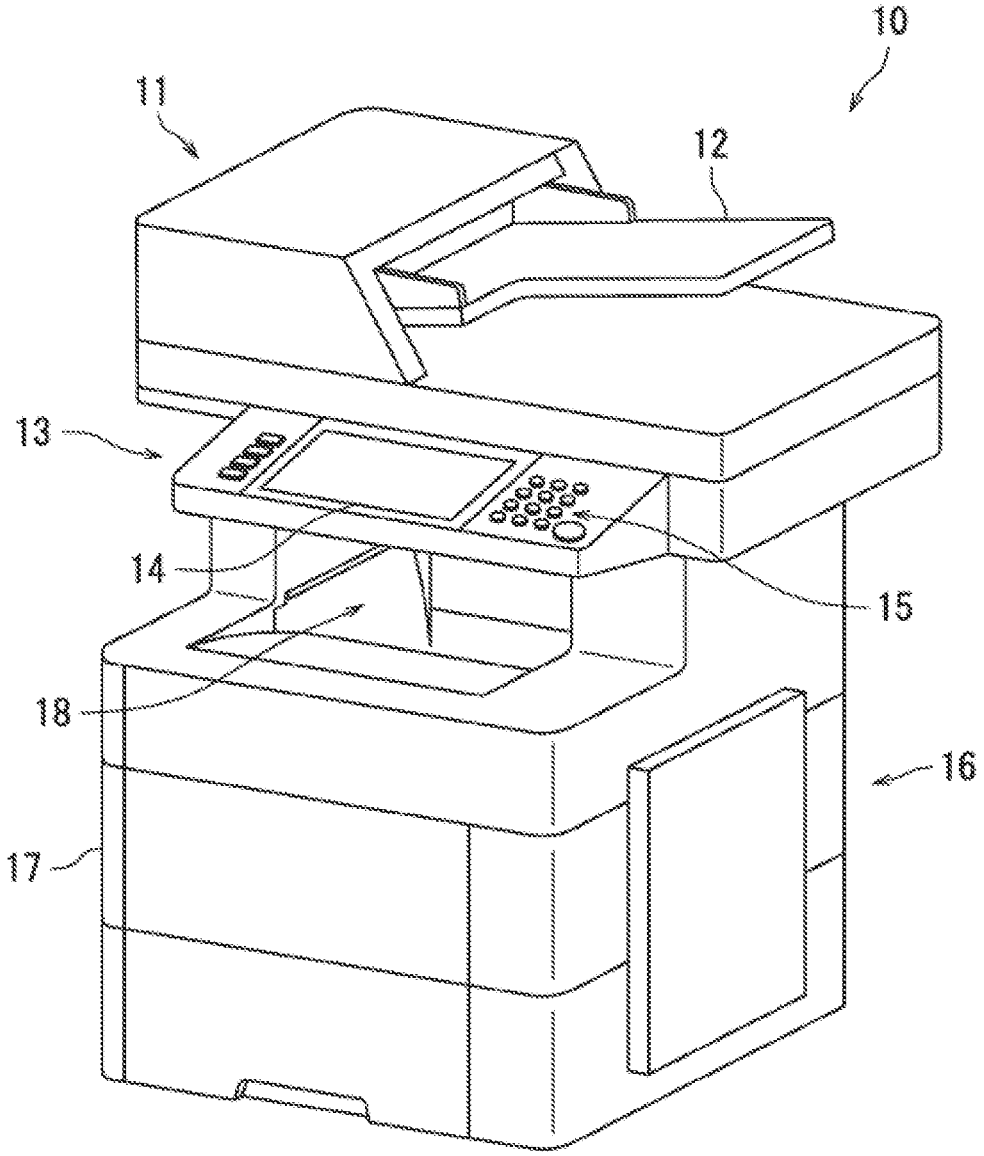
FIG. 1 is a perspective view showing an image forming apparatus according to an embodiment of the disclosure.

Hereafter, an embodiment of the disclosure will be described, with reference to the drawings. In the drawings, the same or corresponding elements are given the same numeral, and the description of such elements will not be repeated.

Referring first to FIG. 1, an image forming apparatus 10 will be described hereunder. FIG. 1 is a perspective view showing the image forming apparatus 10 according to the embodiment of the disclosure.

As shown in FIG. 1, the image forming apparatus 10 includes a reading device 11, an operation device 13, and an image forming device 16. The image forming apparatus 10 may be exemplified by a printer, a facsimile machine, or a multifunction peripheral.

The reading device 11 includes an automatic document feeder (ADF), and a scanner.

The reading device 11 also includes a document tray 12. Non-illustrated source documents (sheets) placed on the document tray 12 are transported to a non-illustrated document reading surface, by a non-illustrated transport mechanism of the reading device 11, and read by the reading device 11. The image of the source document is converted into image data.

The operation device 13 includes a display device 14 and an input device 15.

The operation device 13 includes a plurality of hardware buttons for receiving instructions from the user, and outputs the instruction received from the user to a controller 20, to be subsequently described with reference to FIG. 2.

The display device 14 displays various types of information to the user. The display device 14 includes a liquid crystal display (LCD) for example, to display various images. The display may also include a touch panel or a touch sensor. The touch panel outputs the information inputted by the user, to the controller 20. The display having the touch panel function constitutes a part of the input device 15. The input device 15 may include the plurality of hardware buttons of the operation device 13, with which the information can be inputted.

On the input device 15, numerals and marks are provided. The numerals and marks are inputted through the input device 15, according to the user's operation performed on the input device 15.

The touch panel or touch sensor of the display device 14 receives inputs of, for example, an image forming instruction, settings for the image forming, a data transmission/reception instruction, settings for the data transmission/reception, an image reading instruction, and settings for the image reading, according to the user's operation.

The image forming device 16 includes a paper feeding section 17 and an output section 18.

The image forming device 16 includes, thereinside, non-illustrated printing mechanisms such as a paper feeding mechanism, a transport mechanism, an image forming mechanism, and a discharging mechanism.

The paper feeding section 17 includes a paper cassette that can be drawn out from the image forming device 16, and in which the sheets are accommodated. The sheets accommodated in the paper feeding section 17 are delivered to the image forming device 16, by a transport device 32 (see FIG. 3) including a transport route and transport rollers.

The image forming device 16 is, for example, an image forming mechanism based on an electrophotography technique, including a charging mechanism, an exposure mechanism, a developing mechanism, and a transfer mechanism.

On the sheet delivered by the transport device 32, an image is formed with a coloring agent or color material such as a toner, by the charging mechanism, the exposure mechanism, the developing mechanism, and the transfer mechanism of the image forming device 16, and the sheet having the image formed thereon is transported by the transport device 32, to the output section 18. Here, in the case of an ink jet printing system for example, the image forming device 16 is a recording mechanism including ink cartridges, ink heads, and so forth. In such a recording mechanism of the image forming device 16, the sheet delivered thereto undergoes the image forming process, with a coloring agent or color material such as ink. The sheet having the image formed thereon is transported by the transport device 32, to the discharge mechanism.

Then the sheet is delivered, by the discharge mechanism, to the output section 18 including an output tray for stocking the sheets having the image formed thereon.

Referring to FIG. 2 to FIG. 5 in addition to FIG. 1, a specific configuration of the image forming apparatus 10 according to this embodiment will be described hereunder.

Figure 2:
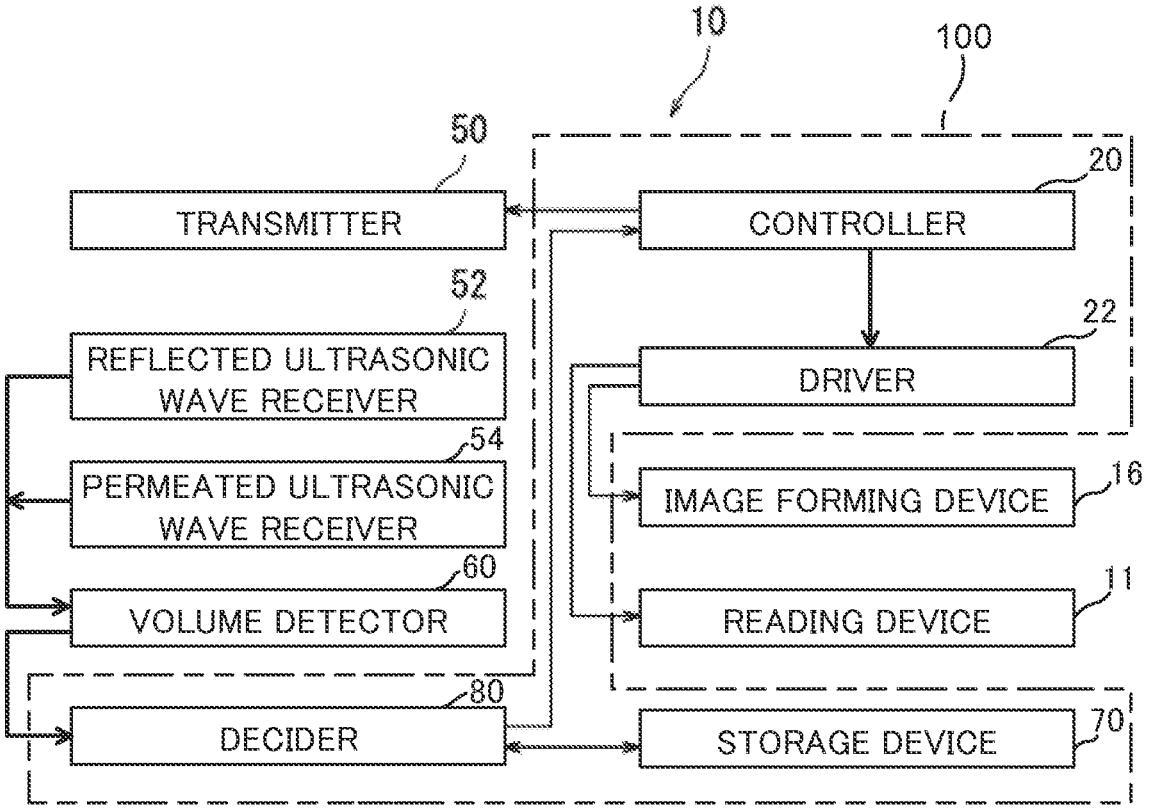
FIG. 2 is a block diagram showing a configuration of the image forming apparatus according to the embodiment.
Figure 3:
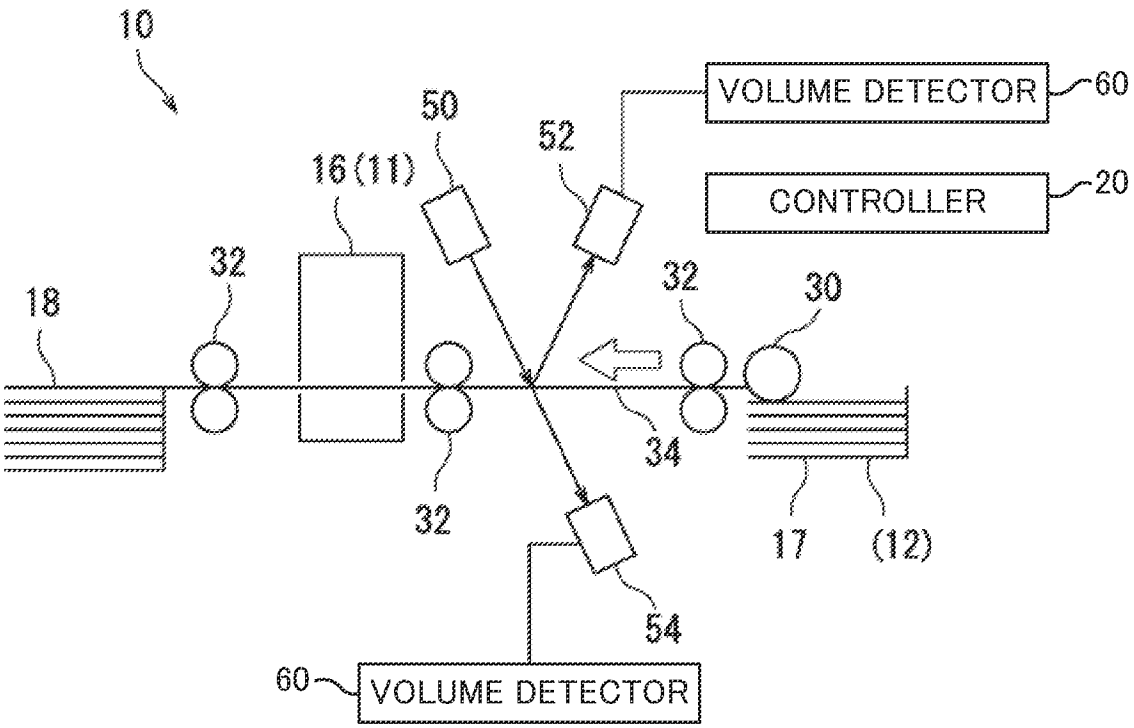
FIG. 3 is a schematic diagram showing the outline of the configuration of the image forming apparatus according to the embodiment.

FIG. 2 is a block diagram showing the configuration of the image forming apparatus 10 according to this embodiment. FIG. 3 is a schematic diagram showing the configuration of the image forming apparatus according to this embodiment. FIG. 3 may be regarded as showing the transport mechanism of the image forming device 16 of the image forming apparatus 10. FIG. 3 may also be regarded as showing the transport mechanism of the reading device 11 of the image forming apparatus 10.

FIG. 4A to FIG. 4D are schematic diagrams each showing a relation of reflected ultrasonic wave and permeated ultrasonic wave, with respect to transmitted ultrasonic wave. FIG. 5 is a table showing data stored in the storage device 70.

The image forming apparatus 10 according to this embodiment includes the paper feeding section 17, the transport device 32, a transmitter 50, a reflected ultrasonic wave receiver 52, a permeated ultrasonic wave receiver 54, a volume detector 60, and a decider 80. The paper feeding section 17 accommodates the sheet therein. The transport device 32 transports the sheet accommodated in the paper feeding section 17.

The transmitter 50 transmits ultrasonic wave of a predetermined volume. The reflected ultrasonic wave receiver 52 receives reflected ultrasonic wave, transmitted from the transmitter 50 and reflected by the sheet. The permeated ultrasonic wave receiver 54 receives permeated ultrasonic wave, transmitted by the transmitter 50 and permeated through the sheet. The volume detector 60 detects reflected volume (P1, P2, P3) of the reflected ultrasonic wave and outputs reflected volume information, and also detects permeated volume (Q1, Q2, Q3) of the permeated ultrasonic wave and outputs permeated volume information. The decider 80 identifies the thickness of the sheet being transported by the transport device 32, and also decides whether multifeed of the sheets is occurring, on the basis of a comparison result between the reflected volume (P1, P2, P3) indicated by the reflected volume information and a reference reflected volume P2, and a comparison result between the permeated volume (Q1, Q2, Q3) indicated by the permeated volume information and a reference permeated volume Q2.

The image forming apparatus 10 includes a control device 100. The control device 100 includes a processor, a random-access memory (RAM), a read-only memory (ROM), a non-volatile memory, and so forth. The processor is, for example, a central processing unit (CPU), an application-specific integrated circuit (ASIC), or a micro processing unit (MPU). The control device 100 acts as the controller 20, a driver 22, and the decider 80, when the processor executes a control program stored in the ROM or the non-volatile memory. The non-volatile memory exemplifies the storage device 70.

The controller 20, the driver 22, the storage device 70, and the decider 80 may be, for example, constituted of an ASIC, independently from the control device 100. Alternatively, the controller 20 may be constituted of a processor such as a CPU or a graphics processing unit (GPU), or of an integrated circuit such as a system-on-a-chip (SoC), independently from the ASIC.

The transmitter 50 includes an oscillator, and an ultrasonic oscillator that converts electric signals outputted from the oscillator into vibration, thereby generating ultrasonic wave, and transmits the ultrasonic wave of a predetermined volume.

The reflected ultrasonic wave receiver 52 includes an ultrasonic oscillator, and receives the reflected ultrasonic wave, transmitted from the transmitter 50 and reflected by an object.

The permeated ultrasonic wave receiver 54 includes an ultrasonic oscillator, and receives the permeated ultrasonic wave, transmitted from the transmitter 50 and permeated through the object.

However, the respective configurations of the transmitter 50, the reflected ultrasonic wave receiver 52, and the permeated ultrasonic wave receiver 54 are not limited to the above. The transmitter 50, the reflected ultrasonic wave receiver 52, and the permeated ultrasonic wave receiver 54 may be realized, for example, by a coder/decoder (CODEC).

The controller 20 shown in FIG. 2 controls the driver 22.

The driver 22 has a driving function, and controls the operation of the image forming device 16 and the reading device 11, according to the instruction of the controller 20. The driver 22 also controls a pickup roller 30 and the transport device 32, when driving the image forming device 16 and the reading device 11.

The transport device 32 transports the sheets stocked in the document tray 12.

The pickup roller 30 picks up the sheet from the paper cassette in the paper feeding section 17, and delivers the sheet to the transport device 32. The pickup roller 30 constitutes a part of the paper feeding section 17.

The transport device 32 transports the sheet. The transport device 32 may also include a retard roller, in addition to the transport roller. The retard roller serves to adjust the timing for transporting the sheet.

The controller 20 controls the transmitter 50.

To be more detailed, the controller 20 looks up, when necessary, the data stored in the storage device 70. The controller 20 executes the commands included in the control program stored in the storage device 70, to control each of the components, thereby realizing various functions.

The transmitter 50 transmits the ultrasonic wave of a predetermined volume P, according to the instruction of the controller 20.

The reflected ultrasonic wave receiver 52 receives the reflected ultrasonic wave, transmitted by the transmitter 50 and reflected by the sheet. The reflected volume (P1, P2, P3) of the reflected ultrasonic wave varies depending on the thickness of the sheet. The reflected volume (P1, P2, P3) of the reflected ultrasonic wave also varies depending on whether the sheet multifeed is occurring.

The volume detector 60 detects the reflected volume (P1, P2, P3) of the reflected ultrasonic wave, and outputs the reflected volume information indicating the reflected volume. More specifically, the volume detector 60 includes an amplifier and an A/D converter, to acquire the reflected volume (P1, P2, P3) of the reflected ultrasonic wave from the reflected ultrasonic wave receiver 52, and to output the reflected volume information, generated by amplifying and digitally converting the acquired volume. However, the configuration of the volume detector 60 is not limited to the above.

The permeated ultrasonic wave receiver 54 receives the permeated ultrasonic wave, transmitted by the transmitter 50 and permeated through the sheet. The permeated volume (Q1, Q2, Q3) of the permeated ultrasonic wave varies depending on the thickness of the sheet. The permeated volume (Q1, Q2, Q3) of the permeated ultrasonic wave also varies depending on whether the sheet multifeed is occurring.

The sheet may be a source document carrying thereon an image. In this embodiment, the sheet includes a plain paper, a thick paper, and a thin paper. The plain paper can be typically exemplified by a copy paper. The thickness of the plain paper is, for example, 0.09 mm. The thick paper can be exemplified by a postcard. The thick paper is thicker than 0.09 mm. The thin paper is, for example, thinner than 0.09 mm. An example of the thin paper is a newspaper.

The volume detector 60 detects the permeated volume (Q1, Q2, Q3) of the permeated ultrasonic wave, and outputs the permeated volume information. More specifically, the volume detector 60 includes the amplifier and the A/D converter, to acquire the permeated volume (Q1, Q2, Q3) of the permeated ultrasonic wave from the permeated ultrasonic wave receiver 54, and to output the permeated volume information, generated by amplifying and digitally converting the acquired volume. However, the configuration of the volume detector 60 is not limited to the above.

The reference reflected volume P2 and the reference permeated volume Q2 are stored in the storage device 70.

The decider 80 identifies the thickness of the sheet being transported by the transport device 32, and also decides whether the sheet multifeed is occurring, on the basis of a comparison result between the reflected volume (P1, P2, P3) indicated by the reflected volume information and the reference reflected volume P2, and a comparison result between the permeated volume (Q1, Q2, Q3) indicated by the permeated volume information and the reference permeated volume Q2.

In this embodiment, it will be assumed that the reflected volume P1 is larger than the reference reflected volume P2. The reflected volume P3 is smaller than the reference reflected volume P2. The permeated volume Q1 is larger than the reference permeated volume Q2. The permeated volume Q3 is smaller than the reference permeated volume Q2.

Figure 4A:
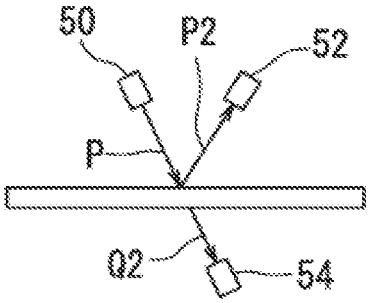
FIG. 4A to FIG. 4D are schematic diagrams each showing a relation of reflected ultrasonic wave and permeated ultrasonic wave, with respect to transmitted ultrasonic wave.

As shown in FIG. 4A and FIG. 5, when a plain paper is transported along the transport route 34 the reflected ultrasonic wave receiver 52 receives the reflected ultrasonic wave having the reflected volume P2 equal to the reference reflected volume P2, and the permeated ultrasonic wave receiver 54 receives the permeated ultrasonic wave having the permeated volume Q2 equal to the reference permeated volume Q2. In other words, the reference reflected volume P2 is set to the value corresponding to the reflected volume of the reflected ultrasonic wave, transmitted by the transmitter 50 and reflected by the plain paper when the plain paper is being transported. The reference permeated volume Q2 is set to the value corresponding to the permeated volume of the permeated ultrasonic wave, transmitted by the transmitter 50 and permeated through the plain paper.

Figure 4B:
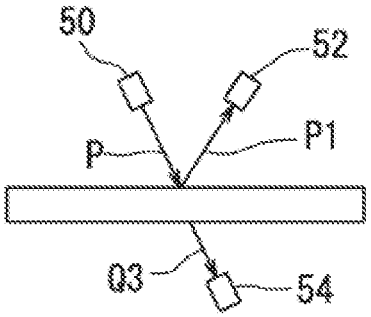

As shown in FIG. 4B and FIG. 5, when a thick paper is transported along the transport route 34, the reflected ultrasonic wave receiver 52 receives the reflected ultrasonic wave having the reflected volume P1 larger than the reference reflected volume P2, and the permeated ultrasonic wave receiver 54 receives the permeated ultrasonic wave having the permeated volume Q3 smaller than the reference permeated volume Q2.

Figure 4C:
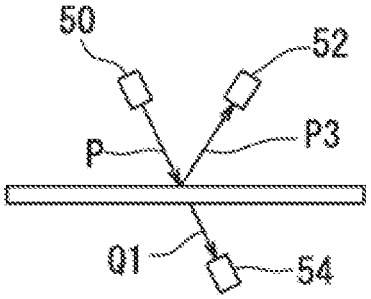

As shown in FIG. 4C and FIG. 5, when a thin paper is transported along the transport route 34, the reflected ultrasonic wave receiver 52 receives the reflected ultrasonic wave having the reflected volume P3 smaller than the reference reflected volume P2, and the permeated ultrasonic wave receiver 54 receives the permeated ultrasonic wave having the permeated volume Q1 larger than the reference permeated volume Q2.

Figure 4D:
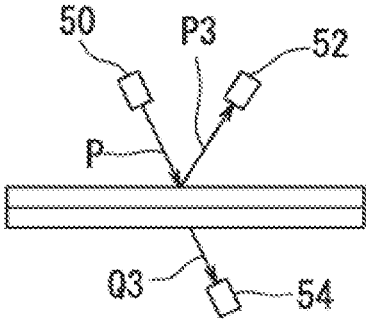

As shown in FIG. 4D and FIG. 5, when the sheet multifeed is occurring on the transport route 34, the reflected ultrasonic wave receiver 52 receives the reflected ultrasonic wave having the reflected volume P3 smaller than the reference reflected volume P2, and the permeated ultrasonic wave receiver 54 receives the permeated ultrasonic wave having the permeated volume Q3 smaller than the reference permeated volume Q2.

The controller 20 controls the driver 22 so as to activate or suspend the operation, according to the information from the decider 80.

The driver 22 drives the image forming device 16 or the reading device 11, or suspends driving the same.

The image forming device 16 forms an image on the sheet.

The reading device 11 reads an image on the sheet, which is, in this case, a source document.

The transport device 32 discharges the sheet, or the source document.

Thus, the image forming apparatus 10 according to this embodiment identifies, on the basis of the information described above, which of the plain paper, the thick paper, and the thin paper is being transported, and decides whether the sheet multifeed is occurring.

Referring to FIG. 4A and FIG. 5 in addition to FIG. 1 to FIG. 3, the example where the plain paper is transported along the transport route 34 will be described, in further detail. FIG. 4A is a schematic diagram showing a relation of the reflected ultrasonic wave and the permeated ultrasonic wave, with respect to the transmitted ultrasonic wave. FIG. 5 is a table showing the data stored in the storage device 70.

In the image forming apparatus 10 according to this embodiment, the decider 80 identifies that the sheet being transported by the transport device 32 is the plain paper, and also decides that the sheet multifeed is not occurring, on the basis of the comparison result that the reflected volume P2 indicated by the reflected volume information is equal to the reference reflected volume P2, and the comparison result that the permeated volume Q2 indicated by the permeated volume information is equal to the reference permeated volume Q2.

In this example, the process up to the point where the transmitter 50 transmits the ultrasonic wave of the predetermined volume P, under the control of the controller 20, is the same as the foregoing description, and therefore the description of such process will not be repeated.

As shown in FIG. 2 and FIG. 3, the reflected ultrasonic wave receiver 52 receives the reflected ultrasonic wave, transmitted by the transmitter 50 and reflected by the sheet.

The volume detector 60 detects the reflected volume P2 of the reflected ultrasonic wave, transmitted by the transmitter 50 and reflected by the sheet, and outputs the reflected volume information. When the sheet being transported by the transport device 32 is the plain paper, the reflected volume P2 of the reflected ultrasonic wave is equal to the reference reflected volume P2, as shown in FIG. 4A and FIG. 5. Upon detecting that the reflected ultrasonic wave receiver 52 has received the reflected volume P2, the volume detector 60 outputs the reflected volume information.

The permeated ultrasonic wave receiver 54 receives the permeated ultrasonic wave, transmitted by the transmitter 50 and permeated through the sheet.

The volume detector 60 detects the permeated ultrasonic wave Q2, transmitted by the transmitter 50 and permeated through the sheet, and outputs the permeated volume information. When the sheet being transported by the transport device 32 is the plain paper, the permeated volume Q2 of the permeated ultrasonic wave is equal to the reference permeated volume Q2, as shown in FIG. 4A and FIG. 5. Upon detecting that the permeated ultrasonic wave receiver 54 has received the permeated volume Q2, the volume detector 60 outputs the permeated volume information.

The reference permeated volume Q2 and the reference reflected volume P2 are stored in the storage device 70.

The decider 80 identifies that the sheet being transported by the transport device 32 is the plain paper, and also decides that the sheet multifeed is not occurring, on the basis of the comparison result between the reflected volume P2 indicated by the reflected volume information and the reference reflected volume P2, and the comparison result between the permeated volume Q2 indicated by the permeated volume information and the reference permeated volume Q2.

More specifically, the decider 80 identifies that the sheet being transported by the transport device 32 is the plain paper, and also decides that the sheet multifeed is not occurring, on the basis of the comparison result that the reflected volume P2 indicated by the reflected volume information is equal to the reference reflected volume P2, and the comparison result that the permeated volume Q2 indicated by the permeated volume information is equal to the reference permeated volume Q2.

The controller 20 controls the driver 22, according to the information from the decider 80.

The driver 22 drives the image forming device 16, or the reading device 11.

The image forming device 16 forms an image on the sheet.

The reading device 11 reads an image on the sheet, in this case the source document.

The transport device 32 discharges the sheet, or the source document.

In this example, as described above, the image forming apparatus 10 decides whether the plain paper is being transported, or the sheet multifeed is occurring, thereby being prevented from making an erroneous decision that the sheet multifeed is occurring, when actually the sheet multifeed is not occurring.

In addition, the image forming apparatus 10 decides whether the plain paper is being transported, or the sheet multifeed is occurring, thereby being prevented from making an erroneous decision that the sheet multifeed is occurring, when actually the plain paper is being normally transported.

Referring to FIG. 4B and FIG. 5 in addition to FIG. 1 to FIG. 3, the example where the thick paper is transported along the transport route 34 will be described.

In the image forming apparatus 10 according to this embodiment, the decider 80 identifies that the sheet being transported by the transport device 32 is the thick paper, and also decides that the sheet multifeed is not occurring, on the basis of the comparison result that the reflected volume P1 indicated by the reflected volume information is larger than the reference reflected volume P2, and the comparison result that the permeated volume Q3 indicated by the permeated volume information is smaller than the reference permeated volume Q2.

In this example, the process up to the point where the transmitter 50 transmits the ultrasonic wave of the predetermined volume P, under the control of the controller 20, is the same as the foregoing description, and therefore the description of such process will not be repeated.

As shown in FIG. 2 and FIG. 3, the reflected ultrasonic wave receiver 52 receives the reflected ultrasonic wave, transmitted by the transmitter 50 and reflected by the sheet.

When the sheet being transported by the transport device 32 is the thick paper, the reflected ultrasonic wave has the reflected volume P1 larger than the reference reflected volume P2, as shown in FIG. 4B and FIG. 5. Upon detecting that the reflected ultrasonic wave receiver 52 has received the reflected volume P1, the volume detector 60 outputs the reflected volume information.

The permeated ultrasonic wave receiver 54 receives the permeated ultrasonic wave, transmitted by the transmitter 50 and permeated through the sheet.

When the sheet being transported by the transport device 32 is the thick paper, the permeated ultrasonic wave has the permeated volume Q3 smaller than the reference permeated volume Q2, as shown in FIG. 4B and FIG. 5. Upon detecting that the permeated ultrasonic wave receiver 54 has received the permeated volume Q3, the volume detector 60 outputs the permeated volume information.

The reference reflected volume P2 and the reference permeated volume Q2 are stored in the storage device 70.

The decider 80 identifies that the sheet being transported by the transport device 32 is the thick paper, and also decides that the sheet multifeed is not occurring, on the basis of the comparison result between the reflected volume P1 indicated by the reflected volume information and the reference reflected volume P2, and the comparison result between the permeated volume Q3 indicated by the permeated volume information and the reference permeated volume Q2.

More specifically, the decider 80 identifies that the sheet being transported by the transport device 32 is the thick paper, and also decides that the sheet multifeed is not occurring, on the basis of the comparison result that the reflected volume P1 indicated by the reflected volume information is larger than the reference reflected volume P2, and the comparison result that the permeated volume Q3 indicated by the permeated volume information is smaller than the reference permeated volume Q2.

The controller 20 controls the driver 22, according to the information from the decider 80.

The driver 22 drives the image forming device 16, or the reading device 11.

The image forming device 16 forms an image on the sheet.

The reading device 11 reads an image on the sheet, in this case the source document.

The transport device 32 discharges the sheet, or the source document.

In this example, as described above, the image forming apparatus 10 decides whether the thick paper is being transported, or the sheet multifeed is occurring, thereby being prevented from making an erroneous decision that the sheet multifeed is occurring, when actually the sheet multifeed is not occurring.

In addition, the image forming apparatus 10 decides whether the thick paper is being transported, or the sheet multifeed is occurring, thereby being prevented from making an erroneous decision that the sheet multifeed is occurring, when actually the thick paper is being normally transported.

Referring to FIG. 4C and FIG. 5 in addition to FIG. 1 to FIG. 3, the example where the thin paper is transported along the transport route 34 will be described.

In the image forming apparatus 10 according to this embodiment, the decider 80 identifies that the sheet being transported by the transport device 32 is the thin paper, and also decides that the sheet multifeed is not occurring, on the basis of the comparison result that the reflected volume P3 indicated by the reflected volume information is smaller than the reference reflected volume P2, and the comparison result that the permeated volume Q1 indicated by the permeated volume information is larger than the reference permeated volume Q2.

In this embodiment, the process up to the point where the transmitter 50 transmits the ultrasonic wave of the predetermined volume P, under the control of the controller 20, is the same as the foregoing description, and therefore the description of such process will not be repeated.

As shown in FIG. 2 and FIG. 3, the reflected ultrasonic wave receiver 52 receives the reflected ultrasonic wave, transmitted by the transmitter 50 and reflected by the sheet.

When the sheet being transported by the transport device 32 is the thin paper, the reflected ultrasonic wave has the reflected volume P3 smaller than the reference reflected volume P2, as shown in FIG. 4C and FIG. 5. Upon detecting that the reflected ultrasonic wave receiver 52 has received the reflected volume P3, the volume detector 60 outputs the reflected volume information.

The permeated ultrasonic wave receiver 54 receives the permeated ultrasonic wave, transmitted by the transmitter 50 and permeated through the sheet.

When the sheet being transported by the transport device 32 is the thin paper, the permeated ultrasonic wave has the permeated volume Q1 larger than the reference permeated volume Q2, as shown in FIG. 4C and FIG. 5. Upon detecting that the permeated ultrasonic wave receiver 54 has received the permeated volume Q1, the volume detector 60 outputs the permeated volume information.

The reference reflected volume P2 and the reference permeated volume Q2 are stored in the storage device 70.

The decider 80 identifies that the sheet being transported by the transport device 32 is the thin paper, and also decides that the sheet multifeed is not occurring, on the basis of the comparison result between the reflected volume P3 indicated by the reflected volume information and the reference reflected volume P2, and the comparison result between the permeated volume Q1 indicated by the permeated volume information and the reference permeated volume Q2.

More specifically, the decider 80 identifies that the sheet being transported by the transport device 32 is the thick paper, and also decides that the sheet multifeed is not occurring, on the basis of the comparison result that the reflected volume P3 indicated by the reflected volume information is smaller than the reference reflected volume P2, and the comparison result that the permeated volume Q1 indicated by the permeated volume information is larger than the reference permeated volume Q2.

The controller 20 controls the driver 22, according to the information from the decider 80.

The driver 22 drives the image forming device 16, or the reading device 11.

The image forming device 16 forms an image on the sheet.

The reading device 11 reads an image on the sheet, in this case the source document.

The transport device 32 discharges the sheet, or the source document.

In this example, as described above, the image forming apparatus 10 decides whether the thin paper is being transported, or the sheet multifeed is occurring, thereby being prevented from making an erroneous decision that the sheet multifeed is occurring, when actually the sheet multifeed is not occurring.

In addition, the image forming apparatus 10 decides whether the thick paper is being transported, or the sheet multifeed is occurring, thereby being prevented from making an erroneous decision that the sheet multifeed is occurring, when actually the thin paper is being normally transported.

Referring to FIG. 4D and FIG. 5 in addition to FIG. 1 to FIG. 3, the example where the sheet multifeed is occurring on the transport route 34 will be described.

In the image forming apparatus 10 according to this embodiment, the decider 80 decides that the sheet multifeed is occurring on the transport device 32, on the basis of the comparison result that the reflected volume P3 indicated by the reflected volume information is smaller than the reference reflected volume P2, and the comparison result that the permeated volume Q3 indicated by the permeated volume information is smaller than the reference permeated volume Q2.

As described above, the image forming apparatus 10 according to this embodiment includes the image forming device 16 and the controller 20. The image forming device 16 forms an image on the sheet. The controller 20 controls the image forming device. In this example, the controller 20 suspends driving the image forming device 16, according to the information from the decider 80.

In addition, the image forming apparatus 10 according to this embodiment includes the reading device 11, and the controller 20. The reading device 11 reads an image provided on the sheet. The controller 20 controls the reading device 11. In this example, the controller 20 suspends driving the reading device 11, according to the information from the decider 80.

In this embodiment, the process up to the point where the transmitter 50 transmits the ultrasonic wave of the predetermined volume P, under the control of the controller 20, is the same as the foregoing description, and therefore the description of such process will not be repeated.

As shown in FIG. 2 and FIG. 3, the reflected ultrasonic wave receiver 52 receives the reflected ultrasonic wave, transmitted by the transmitter 50 and reflected by the sheet.

The volume detector 60 detects the reflected volume of the reflected ultrasonic wave, and outputs the reflected volume information. When the multifeed of the sheets being transported by the transport device 32 is occurring, the reflected ultrasonic wave has the reflected volume P3 smaller than the reference reflected volume P2, as shown in FIG. 4D and FIG. 5. Upon detecting that the reflected ultrasonic wave receiver 52 has received the reflected volume P3, the volume detector 60 outputs the reflected volume information.

The permeated ultrasonic wave receiver 54 receives the permeated ultrasonic wave, transmitted by the transmitter 50 and permeated through the sheet.

The volume detector 60 detects the permeated volume Q of the permeated ultrasonic wave, and outputs the permeated volume information. When the multifeed of the sheets being transported by the transport device 32 is occurring, the permeated ultrasonic wave has the permeated volume Q3 smaller than the reference permeated volume Q2, as shown in FIG. 4D and FIG. 5. Upon detecting that the permeated ultrasonic wave receiver 54 has received the permeated volume Q3, the volume detector 60 outputs the permeated volume information.

The reference reflected volume P2 and the reference permeated volume Q2 are stored in the storage device 70.

The decider 80 decides that the multifeed of the sheets being transported by the transport device 32 is occurring, on the basis of the comparison result between the reflected volume P3 indicated by the reflected volume information and the reference reflected volume P2, and the comparison result between the permeated volume Q3 indicated by the permeated volume information and the reference permeated volume Q2.

More specifically, the decider 80 decides that the multifeed of the sheets being transported by the transport device 32 is occurring, on the basis of the comparison result that the reflected volume P3 indicated by the reflected volume information is smaller than the reference reflected volume P2, and the comparison result that the permeated volume Q3 indicated by the permeated volume information is smaller than the reference permeated volume Q2.

The controller 20 controls the driver 22, according to the information from the decider 80.

The driver 22 suspends the operation of the image forming device 16, or the reading device 11.

In this example, as described above, the image forming apparatus 10 decides that the sheet multifeed is occurring, instead of deciding that a single sheet of the plain paper, the thick paper, or the thin paper is being transported, thereby being prevented from making an erroneous decision that, for example, a single sheet of the thick paper is being normally transported, when actually the sheet multifeed is occurring.

In addition, the image forming apparatus 10 decides whether one of the plain paper, the thick paper, and the thin paper is being transported, or the sheet multifeed is occurring, thereby being prevented from making an erroneous decision that the plain paper, the thick paper, or the thin paper is being normally transported, when actually the sheet multifeed is occurring.

In this example, further, the image forming apparatus 10 suspends driving the image forming device 16, or the reading device 11, only when it is decided that the sheet multifeed is occurring. Therefore, the image forming device 16 and the reading device 11 can be prevented from being erroneously forced to suspend the operation, owing to the erroneous decision that the sheet multifeed is occurring.

Figure 6:
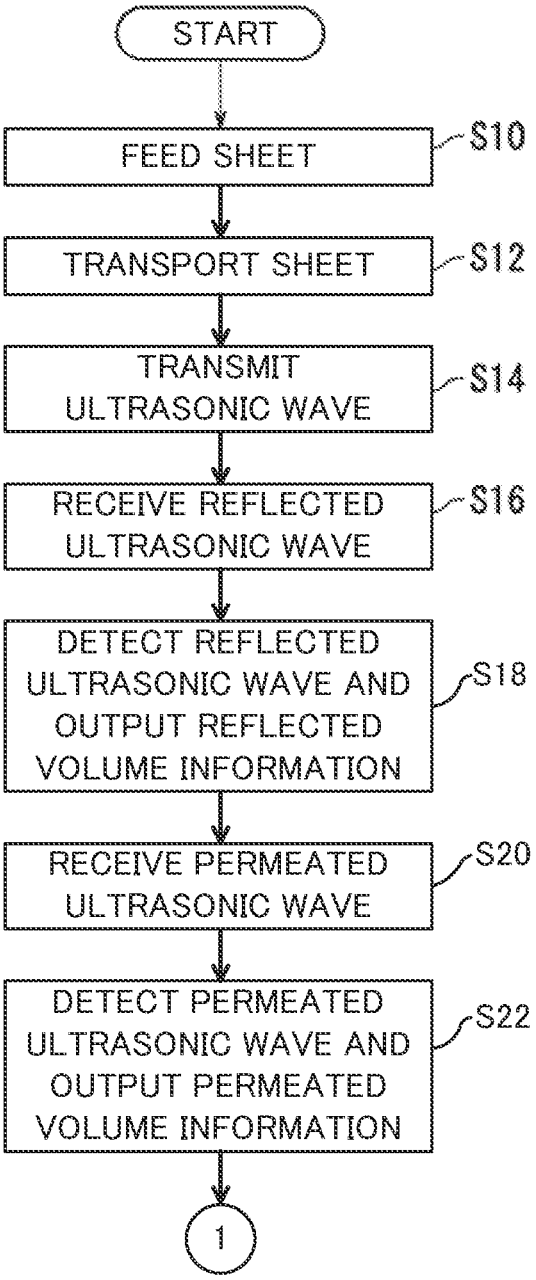
FIG. 6 is a flowchart showing an information processing operation performed by the image forming apparatus according to the embodiment.
Figure 7:
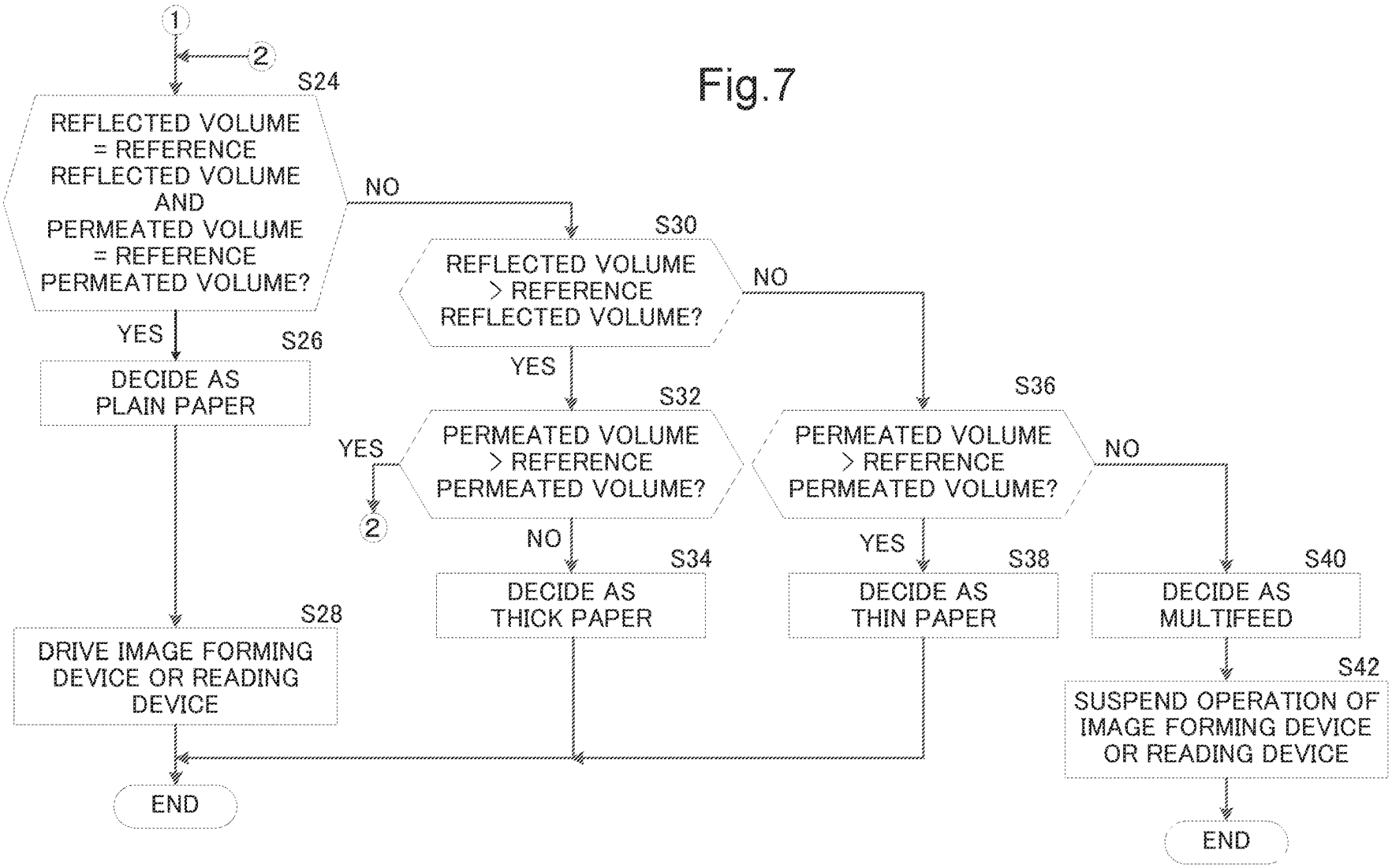
FIG. 7 is a flowchart showing the information processing operation that follows the process of FIG. 6, performed by the image forming apparatus according to the embodiment.

Referring now to FIG. 6 and FIG. 7, an information processing operation, performed by the image forming apparatus 10 according to this embodiment, will be described hereunder. FIG. 6 and FIG. 7 are flowcharts each showing the information processing operation performed by the image forming apparatus 10 according to this embodiment.

As shown in FIG. 6 and FIG. 7, the flowcharts respectively include step S10 to step S22, and step S24 to step S42, each of which will be sequentially described hereunder.

At step S10 shown in FIG. 6, the transport device 32 feeds the sheet stocked on the document tray 12, or stocked in the paper feeding section 17. Then the operation proceeds to step S12.

At step S12, the transport device 32 transports the sheet. Then the operation proceeds to step S14.

At step S14, the transmitter 50 transmits the ultrasonic wave of the predetermined volume P, according to the instruction from the controller 20. Then the operation proceeds to step S16.

At step S16, the reflected ultrasonic wave receiver 52 receives the reflected ultrasonic wave, transmitted by the transmitter 50 and reflected by the sheet. Then the operation proceeds to step S18.

At step S18, the volume detector 60 detects the reflected volume P of the reflected ultrasonic wave, and outputs the reflected volume information. Then the operation proceeds to step S20.

At step S20, the permeated ultrasonic wave receiver 54 receives the permeated ultrasonic wave, transmitted by the transmitter 50 and permeated through the sheet.

At step S22, the volume detector 60 detects the permeated volume Q of the permeated ultrasonic wave, and outputs the permeated volume information. Then the operation proceeds to step S24 shown in FIG. 7.

At step S24, the decider 80 decides whether the reflected volume P indicated by the reflected volume information is equal to the reference reflected volume P2, and whether the permeated volume Q indicated by the permeated volume information is equal to the reference permeated volume Q2 (S24). When those values are equal (YES at S24), the decider 80 decides that the sheet is the plain paper, and that the sheet multifeed is not occurring (S26). The controller 20 drives the image forming device 16 to form an image on the sheet, or drives the reading device 11 to read the image of the sheet (S28). Thereafter, the operation is finished.

When the decider 80 decides at step S24 that the reflected volume P indicated by the reflected volume information is not equal to the reference reflected volume P2, and that the permeated volume Q indicated by the permeated volume information is not equal to the reference permeated volume Q2 either (NO at S24), the decider 80 decides whether the reflected volume P indicated by the reflected volume information is larger than the reference reflected volume P2 (S30).

Upon deciding that the reflected volume P indicated by the reflected volume information is larger than the reference reflected volume P2 (YES at S30), the decider 80 decides whether the permeated volume Q indicated by the permeated volume information is larger than the reference permeated volume Q2 (S32).

In the case where the decider 80 decides, at step S32, that the permeated volume Q indicated by the permeated volume information is not larger than the reference permeated volume Q2, in other words that the permeated volume Q indicated by the permeated volume information is smaller than the reference permeated volume Q2 (NO at S32), the decider 80 decides that the sheet is the thick paper, and that the sheet multifeed is not occurring (S34). Then the operation proceeds to S28.

Here, when the decider 80 decides that the permeated volume Q indicated by the permeated volume information is larger than the reference permeated volume Q2 (YES at S32), the operation returns to step S24, and the operation subsequent to S24 is repeated.

In addition, when the decider 80 decides at step S30 that the reflected volume P indicated by the reflected volume information is not larger than the reference reflected volume P2, in other words that that the reflected volume P indicated by the reflected volume information is smaller than the reference reflected volume P2 (NO at S30), the decider 80 also decides whether the permeated volume Q indicated by the permeated volume information is larger than the reference permeated volume Q2 (S36). Upon deciding that the permeated volume Q indicated by the permeated volume information is larger than the reference permeated volume Q2 (YES at S36), the decider 80 decides that the sheet is the thin paper, and that the sheet multifeed is not occurring (S38). Then the operation proceeds to S28.

However, when the decider 80 decides at step S36 that the permeated volume Q indicated by the permeated volume information is not larger than the reference permeated volume Q2, in other words that the permeated volume Q indicated by the permeated volume information is smaller than the reference permeated volume Q2 (NO at S36), the decider 80 decides that the sheet multifeed is occurring (S40). In this case, the controller 20 suspends the operation of the image forming device 16, or the reading device 11 (S42). Thereafter, the operation is finished.

Now, in the image reading apparatus referred to above as background art, a set of transmitter and receiver is located so as to oppose each other across the document transport route. Therefore, such an image reading apparatus may fail to distinguish between normal transport of a single sheet of an ordinary thickness, and the multifeed of thin documents. Likewise, the image reading apparatus may fail to distinguish between the multifeed of the documents of an ordinary thickness, and normal transport of a single sheet of a thick document.

The arrangement according to the foregoing embodiment, in contrast, enables distinction between the case where the plain paper, the thick paper, or the thin paper is being transported, and the case where the sheet multifeed is occurring, thereby preventing an erroneous decision that the sheet multifeed is occurring from being made, when the sheet multifeed is not occurring.

In addition, the arrangement according to the foregoing embodiment enables distinction between the case where the thick paper is being transported, and the case where the sheet multifeed is occurring, thereby preventing an erroneous decision that the sheet multifeed is occurring from being made, when the thick paper is being normally transported.

The embodiment of the disclosure has been described as above, with reference to the drawings. However, the disclosure is not limited to the foregoing embodiment, but may be implemented in various manners without departing from the scope of the disclosure. The drawings each schematically illustrate the essential constituent elements for the sake of clarity, and the thickness, the length, and the number of pieces of each of the illustrated constituent elements may differ from the actual ones, depending on the convenience in making up the drawings. Further, the material, the shape, and the dimensions of the constituent elements described in the foregoing embodiment are merely exemplary, and may be modified in various manners without substantially departing from the effects expected from the present invention.

INDUSTRIAL APPLICABILITY

The disclosure is applicable to the technical field of the image forming apparatus.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:
a paper feeding section that feeds a sheet;
a transport device that transports the sheet;
a transmitter that transmits an ultrasonic wave of a predetermined volume;
a reflected ultrasonic wave receiver that receives a reflected ultrasonic wave, transmitted from the transmitter and reflected by the sheet;
a permeated ultrasonic wave receiver that receives a permeated ultrasonic wave, transmitted by the transmitter and permeated through the sheet;
a volume detector that detects a reflected volume of the reflected ultrasonic wave and outputs reflected volume information, and also detects a permeated volume of the permeated ultrasonic wave and outputs permeated volume information; and
a decider that identifies a thickness of the sheet being transported by the transport device, and decides whether multifeed of sheets is occurring, on a basis of a comparison result between the reflected volume indicated by the reflected volume information and a reference reflected volume, and a comparison result between the permeated volume indicated by the permeated volume information and a reference permeated volume.

2. The image forming apparatus according to claim 1, wherein the decider decides whether (i) the sheet is one of a plain paper, a thick paper, and a thin paper, and the sheet multifeed is not occurring, or (ii) the sheet multifeed is occurring, on a basis of a combination of a result of comparison in magnitude between the reflected volume indicated by the reflected volume information and the reference reflected volume, and a result of comparison in magnitude between the permeated volume indicated by the permeated volume information and the reference permeated volume.

3. The image forming apparatus according to claim 1, wherein the decider decides that the sheet being transported by the transport device is a plain paper, and that the sheet multifeed is not occurring, on a basis of a comparison result that the reflected volume indicated by the reflected volume information is equal to the reference reflected volume, and a comparison result that the permeated volume indicated by the permeated volume information is equal to the reference permeated volume.

4. The image forming apparatus according to claim 1, wherein the decider decides that the sheet being transported by the transport device is a thick paper, and that the sheet multifeed is not occurring, on a basis of a comparison result that the reflected volume indicated by the reflected volume information is larger than the reference reflected volume, and a comparison result that the permeated volume indicated by the permeated volume information is smaller than the reference permeated volume.

5. The image forming apparatus according to claim 1, wherein the decider decides that the sheet being transported by the transport device is a thin paper, and that the sheet multifeed is not occurring, on a basis of a comparison result that the reflected volume indicated by the reflected volume information is smaller than the reference reflected volume, and a comparison result that the permeated volume indicated by the permeated volume information is larger than the reference permeated volume.

6. The image forming apparatus according to claim 1, wherein the decider decides that the multifeed of the sheets being transported by the transport device is occurring, on a basis of a comparison result that the reflected volume indicated by the reflected volume information is smaller than the reference reflected volume, and a comparison result that the permeated volume indicated by the permeated volume information is smaller than the reference permeated volume.

7. The image forming apparatus according to claim 6, further comprising:

an image forming device that forms an image on the sheet; and a controller that controls the image forming device, wherein the controller suspends an operation of the image forming device, according to a decision made by the decider that the sheet multifeed is occurring.

8. The image forming apparatus according to claim 6, further comprising:

a reading device that reads an image on the sheet; and a controller that controls the reading device, wherein the controller suspends an operation of the reading device, according to a decision made by the decider that the sheet multifeed is occurring.

* * * * *